US005079399A

United States Patent [19]

Itoh et al.

[11] Patent Number: 5,079,399

[45] Date of Patent: Jan. 7, 1992

[54] HIGH-FREQUENCY INDUCTION HEATING APPARATUS

[75] Inventors: Hiroshi Itoh; Toshihiro Yokoo, both of Kanagawa, Japan

[73] Assignee: Denki Kogyo Co., Ltd., Tokyo, Japan

[21] Appl. No.: 562,866

[22] Filed: Aug. 6, 1990

[51] Int. Cl.[5] ..... H05B 6/06

[52] U.S. Cl. ..... 219/10.77; 219/10.71; 363/56; 323/902

[58] Field of Search ..... 219/10.77, 10.75, 10.493, 219/10.71; 363/56, 95, 96, 97, 135, 131; 323/221, 902

[56] References Cited

U.S. PATENT DOCUMENTS 4,484,295 11/1984 Bedard et al. ..... 323/322
4,654,770 3/1987 Santurtûn et al. ..... 363/56
4,673,864 6/1987 Dessens et al. ..... 323/221
4,816,980 3/1989 Wiendl ..... 363/68

*Primary Examiner*—Philip H. Leung
*Attorney, Agent, or Firm*—Fleit, Jacobson, Cohn, Price, Holman & Stern

[57] ABSTRACT

A high-frequency induction heating apparatus of an inverter type includes a high-frequency oscillator using a plurality of switching elements turning on and off at a high speed. A control unit for controlling the high-frequency oscillator includes a plurality of driving circuits for driving the switching elements and a control circuit for controlling the respective driving circuits, and interconnection between the driving circuits and the control circuit is made by optical fiber cables so that influence by external electromagnetic induction is not effected to operate the high-frequency induction heating apparatus effectively.

4 Claims, 5 Drawing Sheets

HIGH-FREQUENCY INDUCTION HEATING APPARATUS

FIELD OF THE INVENTION AND RELATED ART STATEMENT

The present invention relates to a high-frequency induction heating apparatus of an inverter type using a plurality of switching elements turning on and off in a high-frequency oscillator, and more particularly to a high-frequency induction heating apparatus using an optical fiber cable in order to avoid electromagnetic induction trouble in a control system thereof.

Heretofore, a high-frequency induction heating apparatus operating at a frequency of 10 kHz or more has used vacuum tubes, while the emergence of a static induction transistor having short turning on and off time and a power semiconductor switching capable of switching at a high speed such as a power MOS transistor, a bipolar MOS FET or an IGBT (Insulated Gate Bipolar Transistor) spreads of high-frequency induction heating apparatus of an inverter type using the above elements in a high-frequency oscillator.

FIGS. 4 and 5 show circuit configurations of conventional high-frequency induction heating apparatuses. In FIG. 4, numeral 1 denotes a D.C. power source, 2 a high-frequency oscillator using the switching elements 2*a* and 2*a* to be formed into a voltage type single-phase bridge, 3 a matching unit including a series resonance circuit 3*a*, 4 a heating coil which is a load, and 5 a control circuit. Further, in FIG. 5, numeral 6 denotes a high-frequency oscillator using the switching elements 6*a* and 6*a* to be formed into a current type single-phase bridge, a matching unit 7 including a parallel resonance circuit 7*a*, and 1, 4 and 5 denote like elements to those of FIG. 4.

In FIGS. 4 and 5, the control circuit 5 is supplied with a voltage across a condenser $C_3$ or $C_7$ in the resonance circuit 3*a* or 7*a* of the matching circuit 3 or 7 through a feedback transformer 8 and supplies an oscillation control signal to drive circuits 2*b* and 2*b* or 6*b* and 6*b* of the switching elements 2*a*, 2*a* or 6*a*, 6*a* through a PLL (phase locked loop) circuit provided therein so that phases of a high-frequency output voltage and output current are coincident, that is, a power factor of the output is 1.0. The oscillation control signal supplied to the drive circuit 2*b*, 2*b* or 6*b*, 6*b* is a digital signal with controlled high accuracy and a signal transmission line for the oscillation control signal uses any one of a twisted wire, a shield wire, a coaxial cable or the like.

However, in the inverter type high-frequency induction heating apparatus using the power semiconductor switching elements 2*a*, 2*a* or 6*a*, 6*a* switching at a high speed in the high-frequency oscillator 2 or 6, since a transmission distance of the control signal from the control circuit to the drive circuits 2*b*, 2*b* or 6*b*, 6*b* is long, the transmission line is adversely affected by noises introduced externally. That is, a surge (spike) voltage noise generated by turning off of the switching elements 2*a*, 2*a* or 6*a*, 6*a* is superposed on the transmission line by the electromagnetic induction.

If a low frequency oscillation signal is used for driving, the surge voltage noise can be reduced by a filter or the like, while, in a high frequency driving, the oscillation control signal itself is also distorted, so that control is often impossible.

Particularly, in a large capacity high-frequency induction heating apparatus, since the number of switching elements is increased to lengthen the transmission line for the control signal and a large power switching is performed, the transmission line is adversely affected by the surge voltage noise due to a larger electromagnetic induction.

OBJECT AND SUMMARY OF THE INVENTION

The present invention has been made in view of the above problems and an object of the present invention is to solve the above problems and provide a high-frequency induction heating apparatus including a transmission line for a control signal extending from a control circuit to a high-frequency oscillator and which is not affected by external electromagnetic induction.

In order to achieve the above object, the high-frequency induction heating apparatus of an inverter type including a high-frequency oscillator using a plurality of switching elements turning on and off at a high speed and control means for controlling the high-frequency oscillator, is characterized in the following (1) and (2):

(1) The control means comprises a plurality of driving circuits for driving the switching elements and a control circuit for controlling the respective driving circuits and interconnection between the driving circuits and the control circuit is made by optical fiber cables.

(2) The control means comprises a plurality of driving circuits for driving the switching elements, a signal distribution circuit disposed near the driving circuits to distribute a control signal to the respective driving circuits, and a control circuit for applying the control signal to the signal distribution circuit, and interconnection between the signal distribution circuit and the control circuit is made by optical fiber cables.

Operation of the present invention is now described.

FIG. 1 is a block diagram showing a configuration of a high-frequency induction heating apparatus for a small capacity according to the present invention. In FIG. 1, since the number of the switching elements used in the high-frequency oscillator is small in the case of the small capacity, the control circuit is directly connected to the driving circuits by means of the optical fiber cables so that an oscillation control signal is transmitted to drive the high-frequency oscillator.

FIG. 2 is a block diagram showing a configuration of a high-frequency induction heating apparatus for a large capacity according to the present invention. In FIG. 2, even in the case of the large capacity, the control circuit may be directly connected to the driving circuits by means of the optical fiber cables. However, since the number of the switching elements used in the high-frequency oscillator is large, the control circuit is once connected to the signal distribution circuit through the optical fiber cable to transmit the control signal to the signal distribution circuit. The signal distribution circuit is disposed so that a distance of the transmission line of the oscillation control signal from the signal distribution circuit to the driving circuits for the switching elements is shortest and distances to the respective driving circuits are substantially equal. The oscillation control signal is transmitted from the signal distribution circuit to the driving circuits to drive the switching elements. At this time, the signal transmission lines extending from the signal distribution circuit to the driving circuits may be a twisted wire, a shield wire or a coaxial cable.

Since the present invention is configured as above, the optical fiber cable is used in the transmission line of the oscillation control signal in the control means and an electrical control signal is converted into an optical control signal at the output end of the control circuit to transmit this signal in the optical fiber cable while the optical control signal is converted into the electrical control signal at the input end of the driving circuit or the signal distribution circuit again.

Accordingly, even if the transmission line is long, noise due to external electromagnetic induction, particularly surge voltage noise produced by turning off of the switching element itself is not superposed on the optical fiber cable on which the control signal is transmitted. Further, the control circuit is electrically isolated from the high-frequency oscillator.

As apparent from the foregoing description, even if the transmission line constituted of the optical fiber cable is long, the transmission line is not quite influenced by external electromagnetic induction.

Accordingly, the high-frequency induction heating apparatus according to the present invention can operate effectively at a stable frequency. Further, the oscillation control circuit can be used separately from the high-frequency oscillator.

DETAILED DESCRIPTION OF A PREFERRED EMBODIMENT

A preferred embodiment according to the present invention is now described in detail with reference to drawings.

Figure 1:
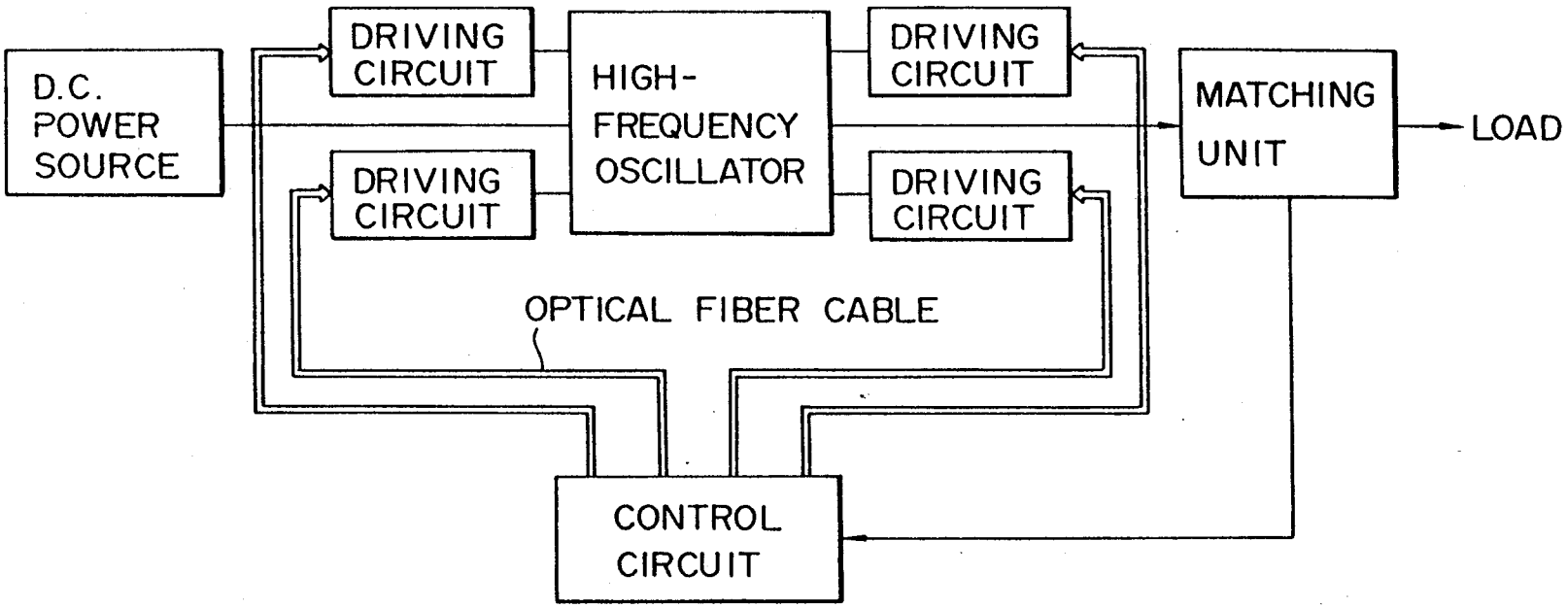
FIGS. 1 and 2 are block diagrams showing configuration of high-frequency induction heating apparatus according to the present invention, in which the apparatus shown in FIG. 1 is of a small capacity and the apparatus shown in FIG. 2 is of a large capacity.
Figure 2:
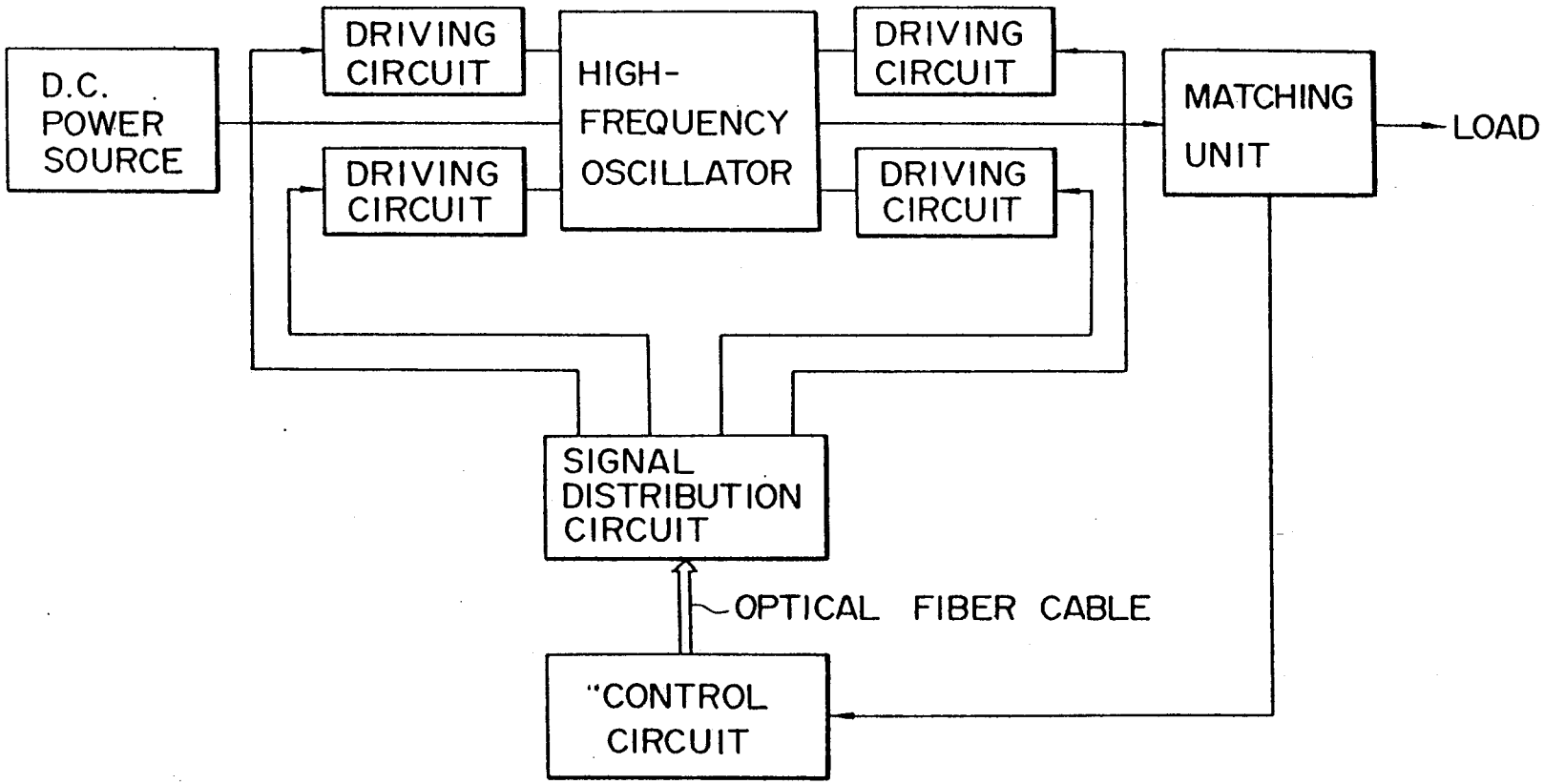
Figure 3:
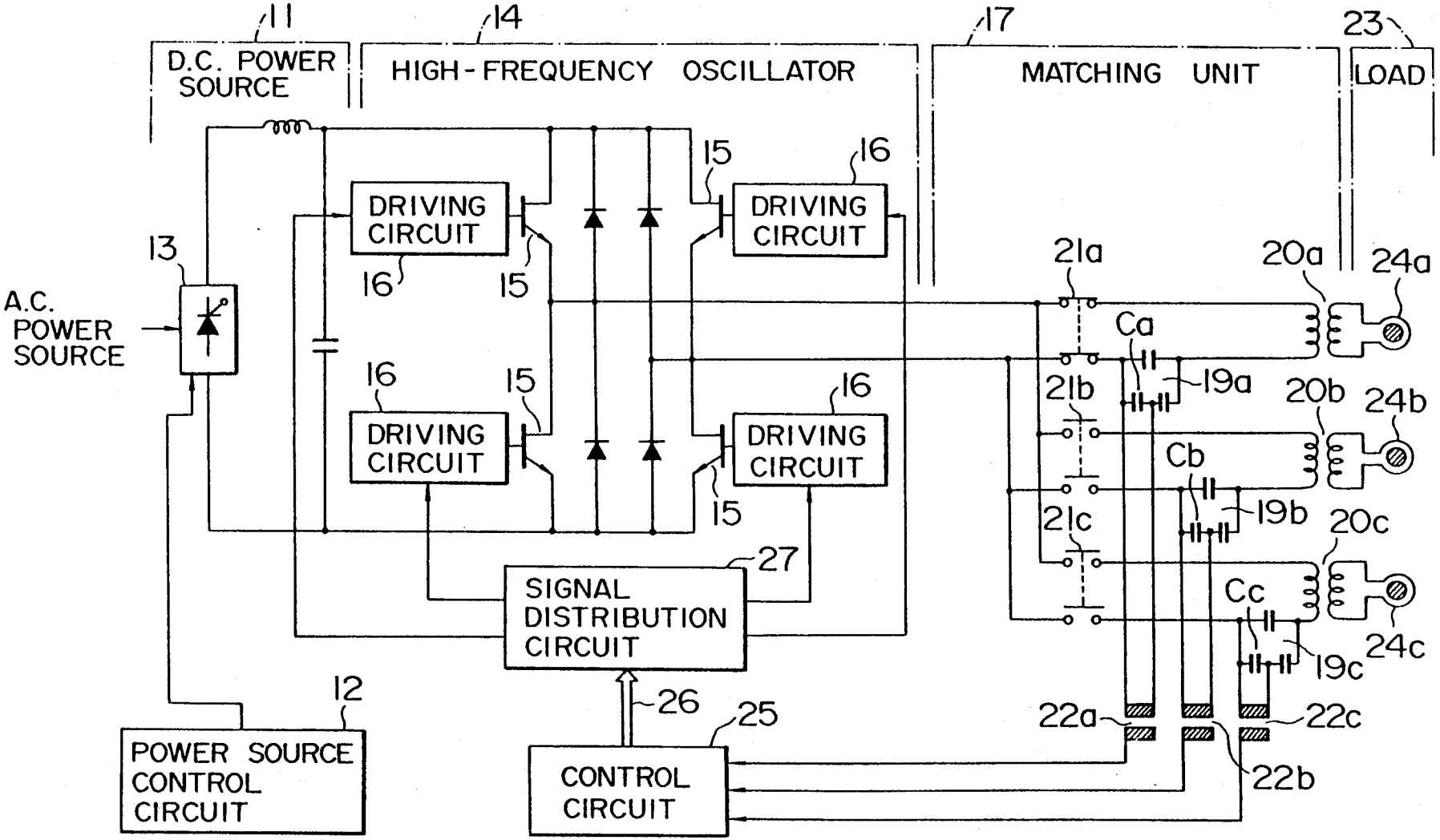
FIG. 3 is a circuit configuration diagram of a high-frequency induction heating apparatus according to an embodiment of the present invention.
Figure 4:
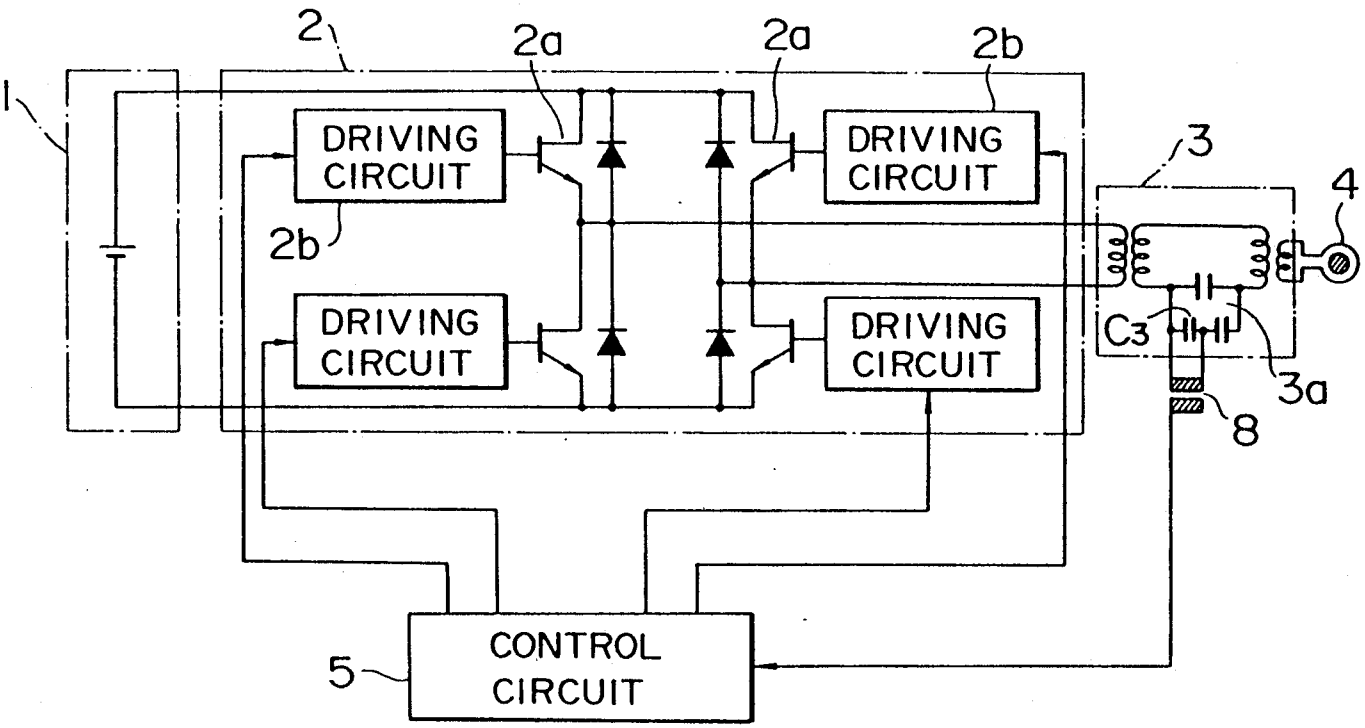
FIG. 4 PRIOR ART
FIGS. 4 and 5 are circuit configuration diagrams of conventional high-frequency induction heating apparatuses.
Figure 5:
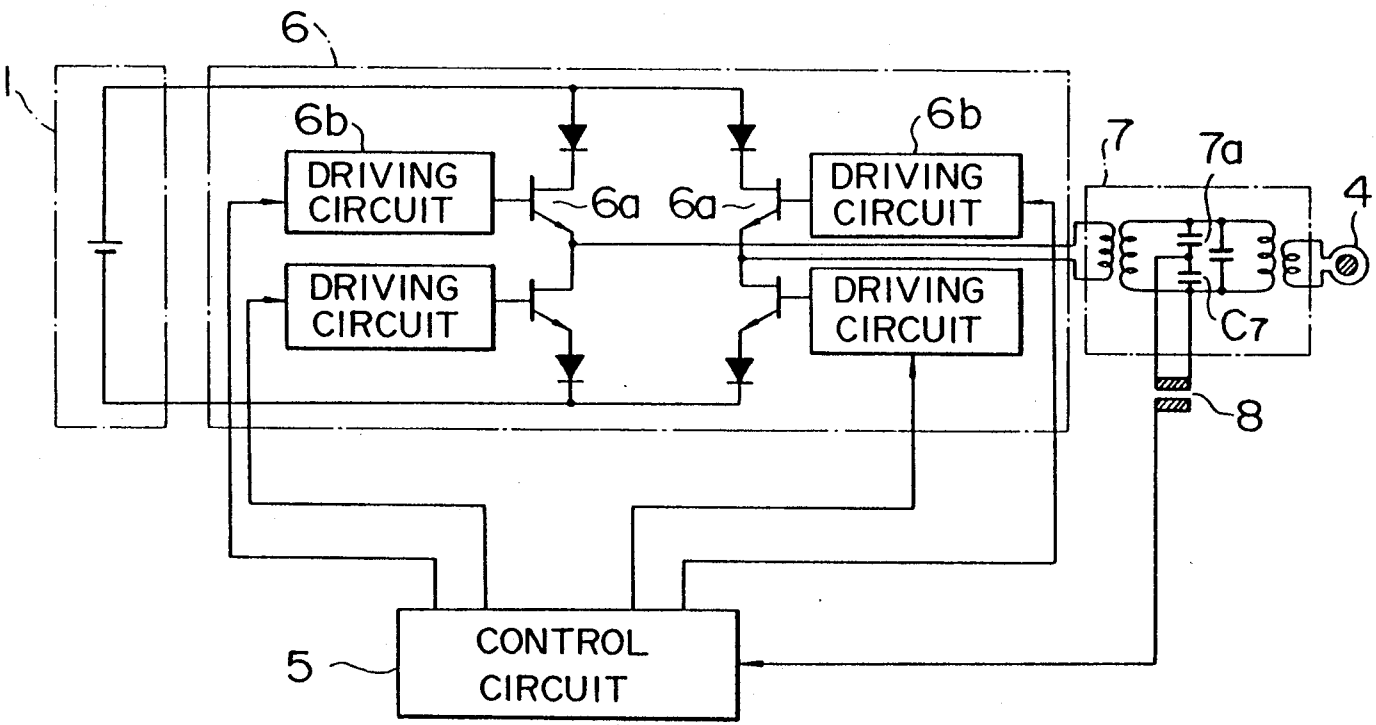
FIG. 5 PRIOR ART

FIG. 3 is a circuit configuration diagram of a high-frequency induction heating apparatus according to an embodiment of the present invention, which uses static induction transistors and has frequencies of 30 kHz, 100 kHz and 200 kHz and an output of 300 kW.

In FIG. 3, a D.C. power source 11 uses a thyristor rectifier 13 controlled by a power source control circuit 12. A high-frequency oscillator 14 includes an inverter circuit of a voltage type single phase bridge structure using a plurality of static induction transistors 15. The transistors 15, 15 are driven by corresponding driving circuits 16, 16. An output signal of the high-frequency oscillator 14 is supplied to a matching unit 17. The matching unit 17 includes condenser circuits 19*a*, 19*b* and 19*c* which are resonated in series at frequencies of 30 kHz, 100 kHz and 200 kHz, respectively, output transformers 20*a*, 20*b* and 20*c*, switching devices 21*a*, 21*b* and 21*c*, feedback transformers 22*a*, 22*b* and 22*c* for feeding back voltages across condensers Ca, Cb and Cc in the condenser circuits 19*a*, 19*b* and 19*c*, respectively. An output signal having any one of the frequencies of 30 kHz, 100 kHz and 200 kHz is supplied through the output transformer to any one of heating coils 24*a*, 24*b* and 24*c* in a load 23 by switching of the switching devices 21*a*, 21*b* and 21*c*.

A control circuit 25 includes a PLL circuit for controlling oscillation of the high-frequency oscillator 14 and drives the driving circuits 16, 16 through a signal distribution circuit 27 connected through an optical fiber 26 to the control circuit 25. Further, the control circuit 25 is operated so that phases of a desired high-frequency output voltage and output current are completely coincident by the feedback of one of the feedback transformers 22*a*, 22*b* and 22*c* in the matching unit 17.

The signal distribution circuit 27 is disposed so that distances of lines for transmitting the oscillation control signal to the driving circuits 16, 16 for the transistors 15, 15 is shortest and preferably the distances are substantially equal to each other. The control signals are transmitted from the signal distribution circuit 27 to the driving circuits 16, 16 to drive the static induction transistors 15, 15 so that a high-frequency output signal is produced.

Since the optical fiber cable 26 connects between the control circuit 25 and the signal distribution circuit 27, an electrical control signal is converted into an optical signal by an electro-optical converter at an output end of the control circuit 25 and the optical signal is transmitted in the optical fiber cable 26. The optical control signal is converted into the electrical control signal again by a photoelectric converter at an input end of the signal distribution circuit 27 to be supplied to the driving circuits 16, 16.

Further, the present invention is not limited to the embodiment described above and other means having the similar function may be used. Various modification and addition can be made to the present invention within the scope of the present invention.

We claim:

1. A high-frequency induction heating apparatus of an inverter type comprising a high-frequency oscillator including at least one switching element turning on and off at a high speed; control means for controlling the high-frequency oscillator; and at least one heating coil, each coupled to a respective one of said plurality of switching elements and activated by said respective ones of said plurality of switching elements;

wherein said control means comprises a plurality of driving circuits for driving said plurality of switching elements and a control circuit for controlling said respective driving circuits, and interconnection between said driving circuits and said control circuit is made by optical fiber cables in which electrical oscillation control signals are converted in said control means to optical control signals and converted back to electrical control signals in said driving circuit thus electrically isolating said control circuit from said high frequency oscillator.

2. An apparatus as claimed in claim 1, wherein said control means further comprises an electro-optical converter for converting said electrical oscillation control signals to optical control signals and said driving circuit comprises a photoelectric converter for converting said optical control signals to electrical control signals.

3. A high-frequency induction heating apparatus of an inverter type comprising a high-frequency oscillator including a plurality of switching elements turning on and off at a high speed; control means for controlling the high-frequency oscillator; and a plurality of heating coils each coupled to a respective one of said plurality of switching elements and activated by said respective ones of said plurality of switching elements;

wherein said control means comprises a plurality of driving circuits for driving said plurality of switching elements, a signal distribution circuit disposed near said driving circuits to distribute a control signal to said respective driving circuits, and a control circuit for applying the control signal to said signal distribution circuit, and interconnection between said signal distribution circuit and said control circuit is made by optical fiber cables in which electrical oscillation control signals are converted in said control means to optical control signals and converted back to electrical control signals in said driving circuit thus electrically isolating said control circuit from said high frequency oscillator.

4. An apparatus as claimed in claim 3, wherein said control means further comprises an electro-optical converter for converting said electrical oscillation control signals to optical control signals and said driving circuit comprises a photoelectric converter for converting said optical control signals to electrical control signals.

* * * * *